US005085134A

United States Patent [19]

Hofstra et al.

[11] Patent Number: 5,085,134

[45] Date of Patent: Feb. 4, 1992

[54] SMOKER'S BOOTH

[76] Inventors: Joseph S. Hofstra, 327 Hathaway Cir., Los Lunas, N. Mex. 87031; Ronald J. Karaskiewicz, 9301 La Grima de Oro, NE., Albuquerque, N. Mex. 87111; Mark R. Fischer, 5704 Flor del Rey, NW., Albuquerque, N. Mex. 87120

[21] Appl. No.: 525,327

[22] Filed: May 17, 1990

[51] Int. Cl.[5] ..... B08B 15/02

[52] U.S. Cl. ..... 454/67; 55/126; 55/316; 55/385.2; 55/385.8; 454/56; 454/344

[58] Field of Search ..... 98/42.02, 4[illegible]. 115.1, 98/115.3; 52/36; 55/385.2, 385.8, 1[illegible]26, 316

[56] References Cited

U.S. PATENT DOCUMENTS

| | | | |
|---|---|---|---|
| 1,274,914 | 8/1918 | McDevitt | 98/42.04 X |
| 1,948,755 | 2/1934 | Gullicksen | 98/42.04 |
| 2,155,495 | 4/1939 | Kuntz | 98/42.04 X |
| 3,427,768 | 2/1969 | Fulton | 52/36 |
| 4,043,776 | 8/1977 | Orel | 55/385.8 |
| 4,105,015 | 8/1978 | Isom | 98/42.04 X |
| 4,177,045 | 12/1979 | Orel | 55/124 X |
| 4,244,710 | 1/1981 | Burger | 55/126 X |
| 4,261,712 | 4/1981 | Kinkade | 55/126 |
| 4,571,898 | 2/1986 | Le Cacheux et al. | 52/36 |
| 4,623,367 | 11/1986 | Paulson | 55/385.1 |
| 4,625,633 | 12/1986 | Martin | 55/385.2 X |
| 4,666,478 | 5/1987 | Boissinut et al. | 98/115.3 X |
| 4,733,507 | 3/1988 | Doublet | 52/63 |
| 4,854,949 | 8/1989 | Giles, Jr. et al. | 126/299 D X |

FOREIGN PATENT DOCUMENTS

| | | | |
|---|---|---|---|
| 968113 | 5/1975 | Canada | 52/36 |
| 2259964 | 8/1975 | France | 52/36 |
| 55-112951 | 9/1980 | Japan | 98/115.1 |
| 1-118049 | 5/1989 | Japan | 98/115.1 |

*Primary Examiner*—Harold Joyce

[57] ABSTRACT

A smoker's booth for isolating, containing, venting, and filtering tobacco smoke. The booth has a walled enclosure with a smoker's access aperture. The presence of a smoker is detected, thereby activating the venting and filtering mechanisms. The booth can be wall mounted or freestanding.

28 Claims, 8 Drawing Sheets

SMOKER'S BOOTH

BACKGROUND OF THE INVENTION

Field of the Invention (Technical Field)

The present invention relates to a wrap-around enclosure or booth as a "designated smoking area" within public or private facilities or outdoors suitable for one or more smokers that isolates, contains, vents and/or filters tobacco smoke. This invention makes it possible for smokers to enjoy a cigarette, cigar, or pipe in public or private buildings or out-of-doors without contaminating the air for non-smokers in the vicinity.

There are four major issues concerning tobacco smoke or smoking: health, productivity, social conflict, and legal compliance/liability. The health effects of primary and secondary smoke include allergies, asthma, emphysema, and increased incidence of lung cancer. There is growing evidence that non-smokers have shown decreased general health in the presence of secondary smoke. Productivity is reduced for smoking employees by at least the amount of time spent smoking and traveling to and from permitted smoking areas. In facilities that have been declared totally non-smoking, the time required to travel from the work location to the outside and back again can be significant. Encounters between smokers and non-smokers are becoming more confrontational and divisive. Local ordinance prohibiting smoking in public buildings, except in designated smoking areas, create a legal obligation for facility owners and managers. Liability arising from smoke related illnesses, or perceived civil rights violations could result in potentially disastrous financial consequences.

Modifications to existing public buildings and facilities, or out-of-doors, to create designated smoking areas that effectively contain and filter tobacco smoke for large numbers of people are difficult and expensive. In all known facilities, such designated smoking areas segregate the population physically into rooms containing either smokers or nonsmokers and do not allow the two groups to commingle in a common area.

Thus, the need exists to provide an isolated smoker's booth or kiosk, which is inexpensive and useful in high traffic areas.

Description of the Related Art Including Information Disclosed under 37 C.F.R. §1.97-1.99 (Background Art)

Various types of booths, enclosures, and tobacco smoke containment and/or filtering devices are already known. Each varies significantly from the present invention.

Canadian Patent No. 968,113, to Anon, entitled Telephone Booth, is intended for use solely as a telephone booth and not as a smoker's booth. It does not contain an ashtray, venting or air filtration system. The size of the enclosure appears incapable of containing the volume of tobacco smoke that is usually produced by a cigarette, cigar, or pipe. The sides of the booth are perforated to allow the air within the booth to exchange freely with the air outside the booth. Thus, this device would not satisfy the obvious requirements of an isolated smoke containment booth.

U.S. Pat. No. 4,733,507, to Doublet, entitled Isolation Hut, teaches a temporary booth made principally of cardboard and useful as a polling booth, not as a smoker's booth. The device contains no air handling, venting, or filtration equipment. Its flammable construction material, lack of an ashtray or fireproof container and non-durable design make it inappropriate as a smoker's booth. Further, its use of floor space makes it unsuitable for high pedestrian traffic areas like the hallways of large public buildings or airport concourses.

U.S. Pat. No. 3,427,768, to Fulton, entitled Booth with a Rotatable Door and Seat, discloses a booth suitable as a telephone booth and not for isolating tobacco smoke. The device does not contain an air movement, venting, or filtration system or an ashtray. When closed, it would trap tobacco smoke created by a cigarette, cigar, or pipe, but would not remove this smoke from the air or prevent it from escaping when the door was opened.

U.S. Pat. No. 4,571,898, to Le Cacheux, et al., entitled Sales Boutique, Especially a Newspaper Kiosk, is designed to be located outdoors and serve as a facility that exhibits and sells small items such as newspapers or magazines, not to isolate or contain smoke. It does not contain air handling, venting, or filtering equipment or ashtrays for smokers.

French Patent No. 74 03884, to More, entitled Habitacle de café, discloses an enclosed circular seating area, a round centrally located table, ceiling lighting, and a floor heating duct. It is designed to be placed outside a café to offer shelter in all washer to customers, and not as a smoker's enclosure. This invention does not contain air handling, venting, or filtration equipment to clean and remove smoke generated within the enclosure. The size and design of the enclosure would not make it appropriate for use as a smoker's booth. It is not suited to the requirements of public facilities that must handle potentially large numbers of smokers within existing floor space and traffic flow requirements.

The device disclosed in U.S. Pat. No. 4,623,367, to Paulson, entitled Smoke-Free Work Area, is shaped like an umbrella covered patio table or a work desk with a hand. These devices are most appropriate for offices or restaurants that have limited traffic flow and sufficient floor space to permit their use by smokers who will remain in the area for an extended period of time. The smokers must be seated and face toward the center of the table for the smoke to be captured by the air handling system. This invention and its embodiments would not be appropriate for high traffic areas, such as hallways or airport concourses. The Paulson device relies on a relatively calm air environment to effectively contain the smoke within the filtering volume of its air handling system. It is not suited to the requirements of public facilities that must handle potentially large numbers of smokers within existing floor space and traffic low requirements. It does not automatically turn on and off when the smoker approaches.

Japanese Patent No. JA 0112951, to Tsujimura, entitled Illuminator, discloses a hood suspended above a table containing a cooking burner or ashtray to capture the smoke that rises in the heat of the light and vent it through the ceiling. A smoker has to remain seated at the table and face inward for the tobacco smoke to be contained by the rising air and overhead hood. This invention is most appropriate for a restaurant or other location where there is floor space suitable for tables and chairs. Modifications to the existing facility must be made to remove the smoke that is exhausted above the ceiling. The illuminator must remain on at all times for this invention to work properly because the heat generated by the incandescent bulb is required to create the updraft that moves smoke into the hood. This device does not have the air containment, movement, venting, and filtration capacity required for an isolated smoker's booth.

Japanese Patent No. JA 0118049, Ehama, entitled Hood Device for Smoking, contains a fan and single paper filter element mounted above a chair. The device is no automatically activated when a smoker enters the area or sits in the chair. The application of this invention is limited to those locations (office and possibly restaurant) that can fix the position of a chair so that the shield screen and down-draft air curtain can be lowered to collect the tobacco smoke. The smoker must remain seated or standing under the hood for the smoke to be contained by this system. The air curtain of this invention will not effectively contain smoke in the turbulent air conditions created in high traffic areas. This invention also requires modifications to the ceiling of the facility to support the hood device.

SUMMARY OF THE INVENTION (DISCLOSURE OF THE INVENTION)

The present invention comprises a smoker's booth for receiving and accommodating one or more smokers and for isolating smokers and tobacco smoke. The smoker's booth comprises a walled enclosure, ceiling, a smoker's access aperture disposed in the walled enclosure for providing ingress and egress for the smokers, and a venting mechanism to vent tobacco smoke from the walled enclosure and away from the vicinity proximate to the walled enclosure.

In the preferred embodiment, the walled enclosure comprises side walls, preferably curved in a wrap-around shape, with the smoker's access aperture disposed between the wrap-around side walls. The walled enclosure further preferably comprises a single back wall for wall-mounting on a flat wall surface, or two back walls which meet in a corner, for wall-mounting in a corner configuration. The back wall or walls are preferably connected to the side walls. For a plurality of smoker's booths, the booths can share at least one wall. The back wall or walls are curved towards the smoker's access aperture at the ceiling to assist in smoke movement towards the vent. When the smoker's booth is wall mounted, the walled enclosure comprises partial walls disposed above the floor surface. When the smoker's booth is disposed on the floor (free standing) or floor mounted, it requires a base. The walled enclosure, particularly the side walls, may be transparent, translucent, or opaque. The walled enclosure may comprise indicia, such as advertising. The walled enclosure may further comprise a door or other closure to close the access to the smoker's booth.

Also in the preferred embodiment, the venting mechanism comprises a fan and at least one exhaust aperture disposed in the ceiling. The smoker's booth further preferably comprises an air intake aperture disposed proximate the smoker's access aperture. Also, the smoker's booth preferably further comprises a filtering system, using a particulate filter, an electrostatic filter, an activated charcoal filter, or combination thereof. The filters are removable from the smoker's booth, preferably through the ceiling. For a plurality of smoker's booths, a common exhaust system, such as a facility heating, venting, and air conditioning system, may be provided.

In the preferred embodiment, the smoker's booth further comprises a sensor for detecting the presence of a person. Sensors, useful in accordance with the invention include infrared, sonic, capacitive sensors and the like. The sensor may automatically activate the venting mechanism, filters, and the light. The sensor may have a predetermined delay for deactivating the venting (and filter and light) after the person exits the smoker's booth. The smoker's booth may further comprise a shelf, ashtray, seat (preferably a foldable seat), vending machine, rack, television, telephone, or the like.

It is a primary object of the present invention to provide a smoker's booth, for containing and venting tobacco smoke, for use within public and private buildings or outside areas.

It is another object of the present invention to provide means to contain and filter primary and secondary tobacco smoke created when an individual smokes a cigarette, cigar or pipe.

Yet another object of the present invention is to provide an enclosure for smoking that does not interrupt normal traffic flow within public and private buildings or out-of-doors.

Still another object of the present invention is to minimize power consumption by the use of a proximity sensor.

An advantage of the present invention is the provision of a smoker's booth that can be matched with facility decor in colors and materials.

A further advantage of the present invention is its portability and ease of construction.

Other objects, advantages and novel features, and further scope of applicability of the present invention will be at set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF THE PREFERRED EMBODIMENTS OF THE INVENTION (BEST MODES FOR CARRYING OUT THE INVENTION)

The present invention relates to a wrap-around enclosure, booth or kiosk having air handling, venting, and filtration devices and a proximity sensor intended to provide a containment and isolation of tobacco smoke within public and private buildings or outdoors. The present invention is suitable for areas that accommodate large numbers of people within, for example, restricted floor spaces, such as airport concourses and gate areas, convention centers exhibit halls, sports arenas, halls within municipal buildings, court houses, manufacturing facilities, hospital waiting rooms, employee break areas, and confined courtyards. The present invention requires little or no facility modifications.

Figure 1:
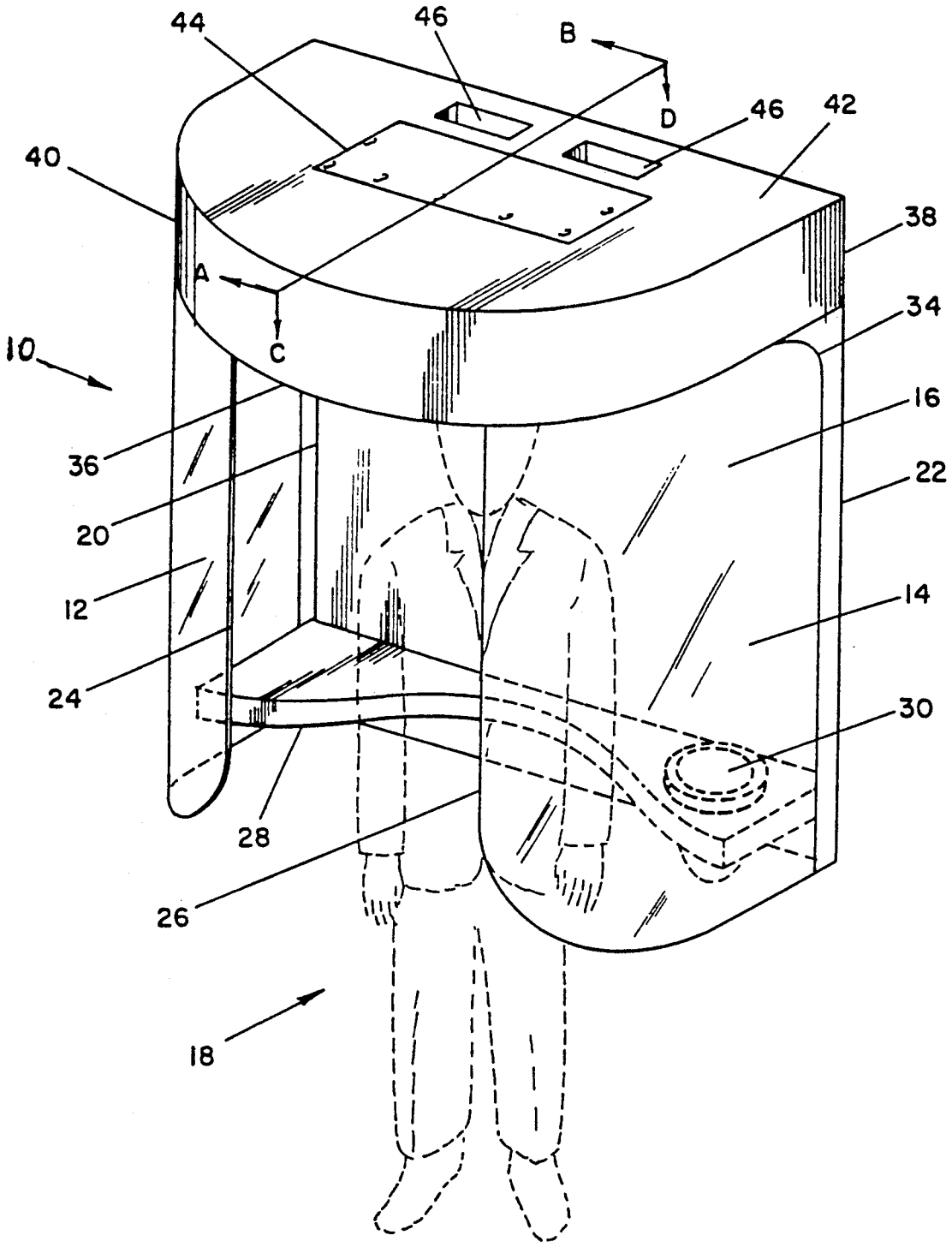
FIG. 1 is a perspective view of the preferred embodiment of the smoker's booth of the present invention.
Figure 2:
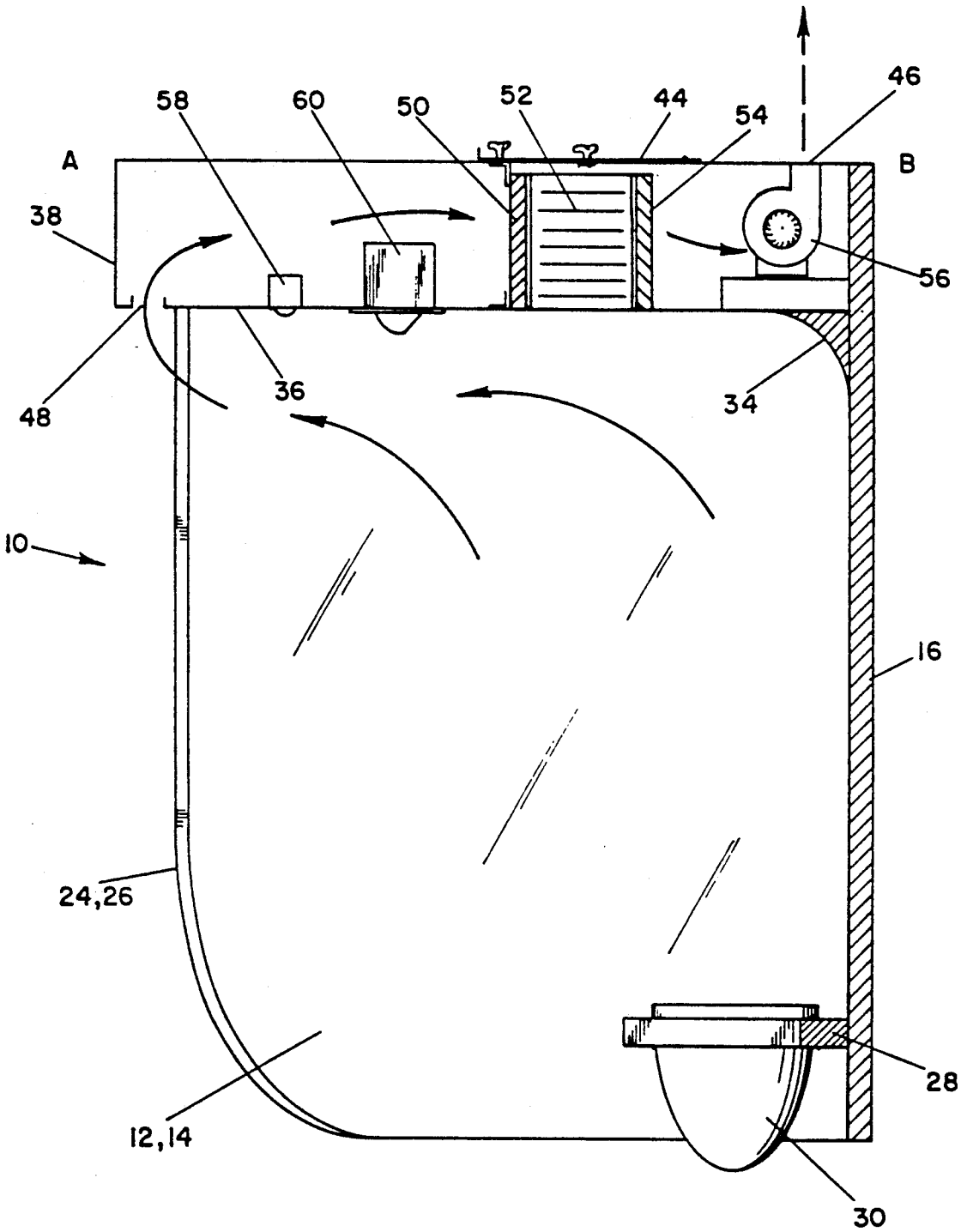
FIG. 2 is a side view of the FIG. 1 embodiment taken along the line A–B showing the arrangement of the sensor, light, filters, and fan, and the movement of air and smoke when the system is activated.
Figure 3:
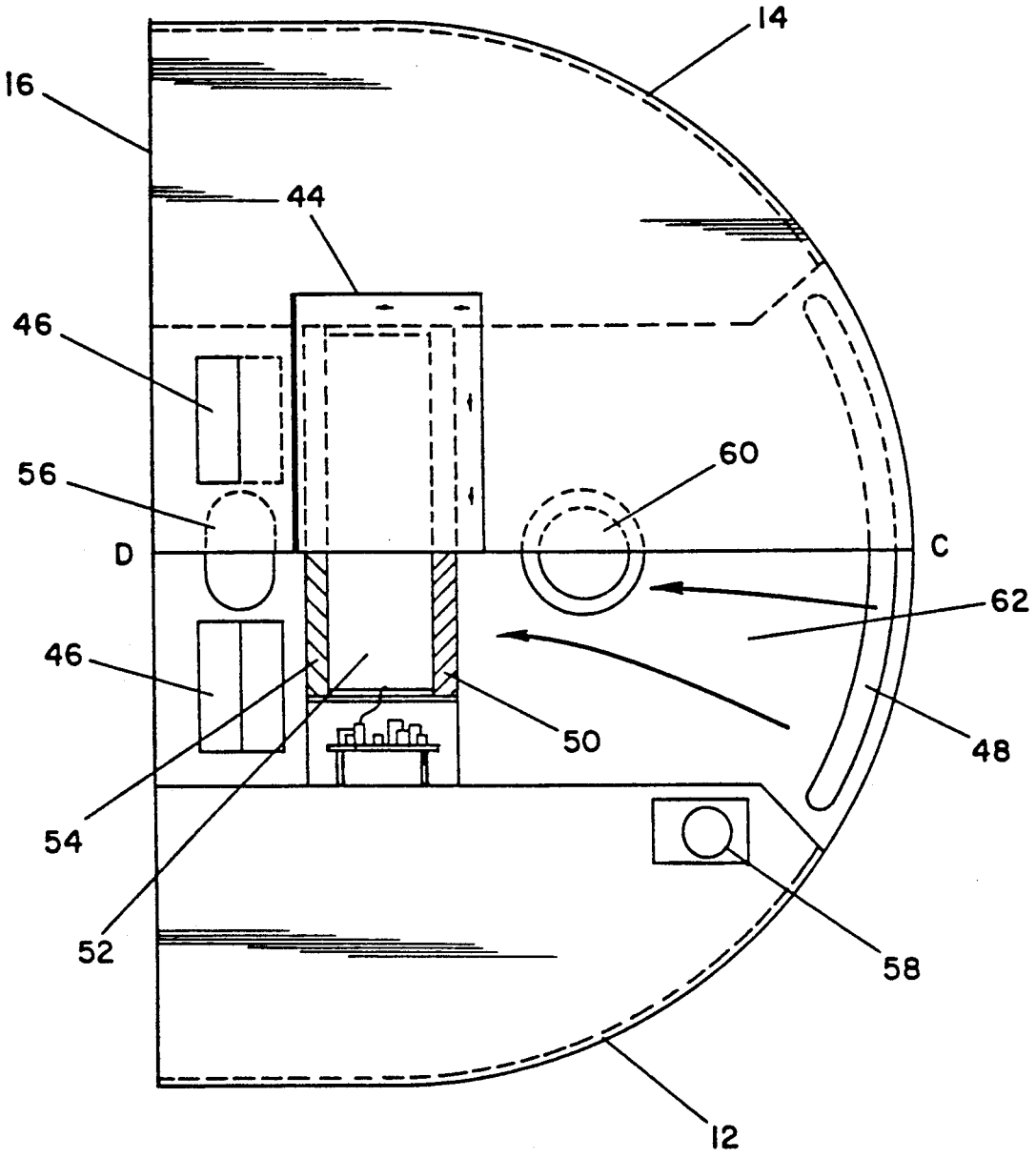
FIG. 3 is a top cutaway plan view of the FIG. 1 embodiment, taken along the line C–D, showing the location of the air inlet and the flow of air and smoke within the booth, and through the air plenum, filters, and fan.

Reference is now made to FIGS. 1-3, which illustrate the preferred embodiment of the invention. FIGS. 1-3 show a wall-mounted smoker's booth 10 intended for use as a contained smoking area is high traffic areas. The smoker's booth 10 may accommodate one or more smokers and comprises a walled enclosure, such as two partial side walls 12 and 14, and back wall 16, and a front smoker's access aperture 18. The rear wall 16 is flat to assist in wall mounting and is joined at each side by curved side walls 12 and 14 at verticle or corner edges 20 and 22. The smoker's booth 10 is preferably and advantageously wall-mounted at its rear wall or surface 16. The side walls 12 and 14 are curved inward along their forward segment to create a front access aperture 18 that is narrower than the width of the booth 10 in that they do not touch the floor. The front access aperture 18 is limited on each side by the forward vertical edges of the side walls 24 and 26. The partial walls 12, 14, and 16 allow for ease of cleaning around the booth 10, in that they do not touch the floor. The preferred embodiment wraps around the smoker(s) to effectively contain primary and secondary smoke and allow the air movement system to quickly clear and the booth 10. The wraparound walled enclosure of the present invention so effectively contains the smoke generated therein that a moderately sized air handling and filtration system can exchange and cleanse the entire volume of air within the booth more than twice every minute so as to maintain a clean, smoke-free environment for nonsmokers in the immediate vicinity.

In the preferred embodiment, the smoker's booth 10 further comprises a convenience shelf 28 for placing packages, purses, briefcases, or the like. This shelf 28 is mounted to the rear wall 16 and side walls 12 and 14. The shelf has a fireproof container or ashtray 30 for tobacco ashes and litter.

The rear wall 16 and side walls 12 and 14 preferably extend from approximately an individual's waist to an eight (8) foot light and are free of the floor, although the present invention could easily be adapted to accommodate a smoker confined to a wheelchair by lowering the booth to the appropriate height and enlarging the access aperture. Optionally, a floor and full length side and rear walls could be utilized in accordance with the invention for certain applications.

The top or ceiling 36 of the booth 10 is shaped to conform to the flat rear wall 16 and the curved side walls 12 and 14. The rear portion of the ceiling curves downward via a curved molding 34 into the flat rear wall 16 to create a surface that aids in moving smoke toward the ceiling 36 and the front of the booth 10 (see arrows). The front edge of the ceiling continues the smooth curve of the side walls 12 and 14 and extends slightly beyond front edges 24 and 26. This extension permits the air intake opening 48, located at the front of the ceiling 36, to be at the most advantageous position to capture smoke from within the booth 10 and prevent its escape into the surrounding environment.

Above the ceiling 36 is the air handling and filtration compartment 38. This compartment 38 is formed by the ceiling 36 as its bottom surface, the rear wall 16, a curved trim band 40 on the sides, and the booth's upper surface 42 on the top. Access to the air handling and filtration compartment 38 for service and repair is through the filter access hatch 44 located in the upper surface 42. The exit for clean, filtered air from the air handling and filtration compartment 38 is through the exhaust ports 46 preferably located at the rear of the top surface 42.

In accordance with the present invention, the rear wall 16, ceiling 36, air handling and filtration compartment 38, curved trim band 40, upper surface 42, filter access hatch 44, and convenience shelf 28 of the smoker's booth 10 are preferably made essentially from strong, durable, fireproof or retardant, and easily cleaned materials, such as wood, aluminum, stainless steel, or molded fiberglass. The curved side walls 12 and 14 are preferably made of durable, high impact or shatterproof, easily cleaned, translucent, transparent, or opaque plastic materials, or laminated safety glass.

Referring specifically to FIG. 2, there is shown the preferred arrangement of a proximity sensor 58, light 60, filters 50, 52, and 54, and fan 56 within the air handling and filtration compartment 38. The air intake opening 48 is located at the forward edge of the ceiling 36 just outside the front edges 24 and 26 of the side walls 12 and 14. This positioning of air intake opening 48 takes advantage of the preferred wrap-around structural shape to capture primary and secondary smoke and move it toward the front access aperture 18 in an air flow pattern created by the fan 56. The high flow rate of air in the vicinity of the air intake opening 48 completely captures any smoke created within the booth 10 even through the front access aperture 18 remains open. The air/smoke flow patterns created by the high volume fan 56 and curved or wrap-around structure of the booth 10 are illustrated in FIG. 2 by the large straight and curved arrows within the booth and air handling and filtration compartment 38.

As can also be seen in FIG. 2, the smoke-air mixture first encounters a particulate filter 50 that removes large, coarse particles, lint, and hair. The smoke-air mixture next enters an electrostatic filter 52 that precipitates the fine smoke (tobacco ash) particles. The last fiber element in the series is activated charcoal 54 to absorb or adsorb noxious tars and resins and remove odors. The filter elements are easily removable for cleaning and service through the filter access hatch 44.

A proximity sensor switch 58 is located in the ceiling just inside the front access aperture 18. This switch 58 sense an individual entering the booth and automatically turns on the fan 56, electrostatic filter 52, and booth light 60. When the smoker exits the booth, the proximity switch 58 or an additional sensor detects the absence of someone within the booth and automatically turns the system off following a present variable delay period to complete evacuation and filtering of any residual smoke within the booth. Infrared, sonic, and capacitive sensors, and the like, are useful in accordance with the invention.

The light 60 is recessed and located centrally in the ceiling 36 to provide light whenever the booth venting and filtering systems are operating. The light 60 is automatically controlled by the proximity switch 58.

FIG. 3, a top cutaway plan view of the booth 10, best illustrates the location of the air inlet 48 and the flow of air and smoke (see arrows) within the booth 10 and through the air plenum chamber 62, filters 50, 52, and 54, and fan 56.

Figure 4:
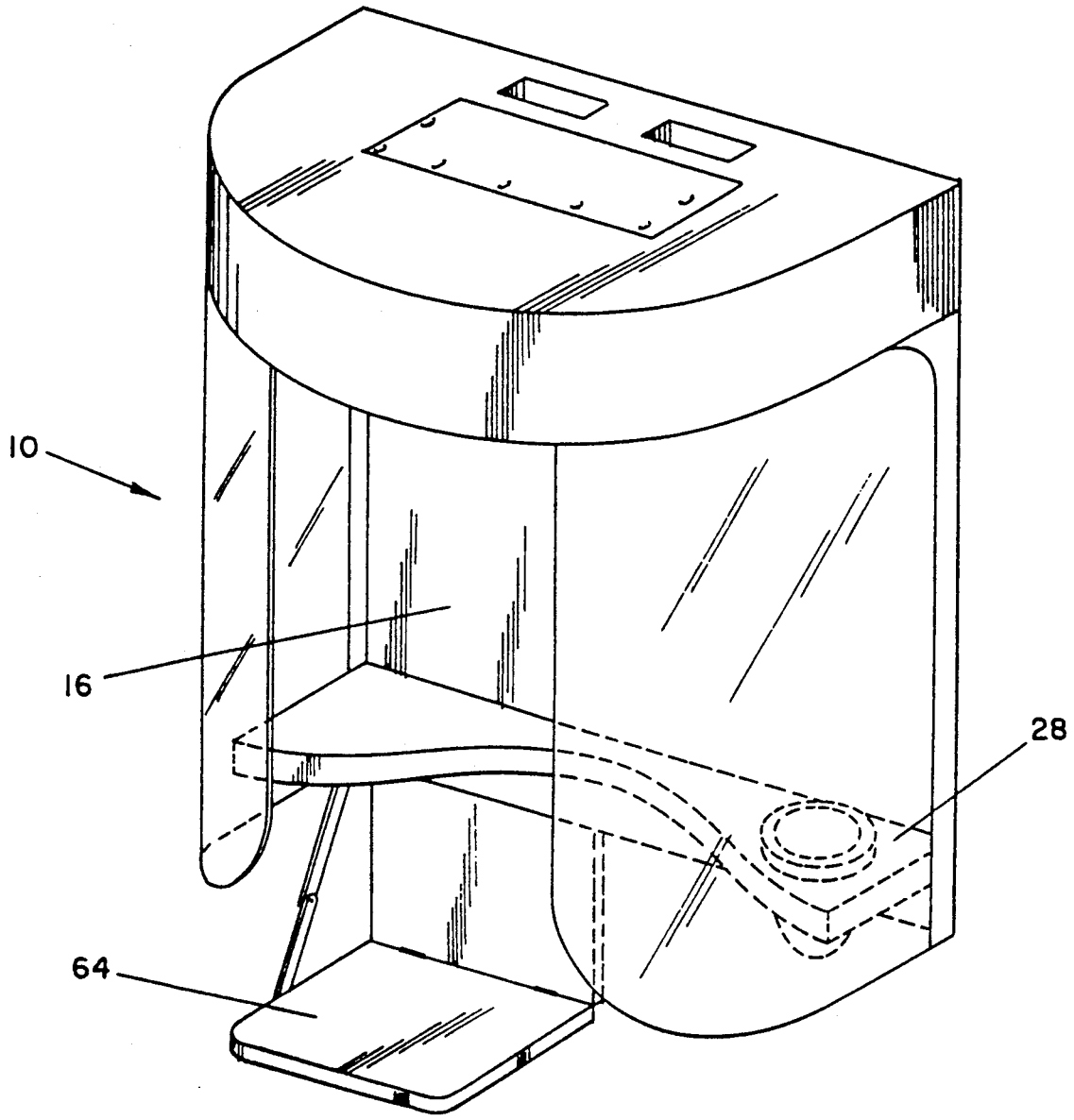
FIG. 4 is a perspective view of an alternative embodiment showing a seat that folds down from the back wall beneath the convenience shelf.

FIG. 4 illustrates an alternative embodiment that includes a fold-down seat 64 located on the back wall 16 beneath the convenience shelf 28. This invention could also be tailored to accommodate two smokers with the appropriate increase in dimensions and addition of a second ashtray and folding seat. Likewise, other types of seats, couches, or the like, may be provided.

Figure 5:
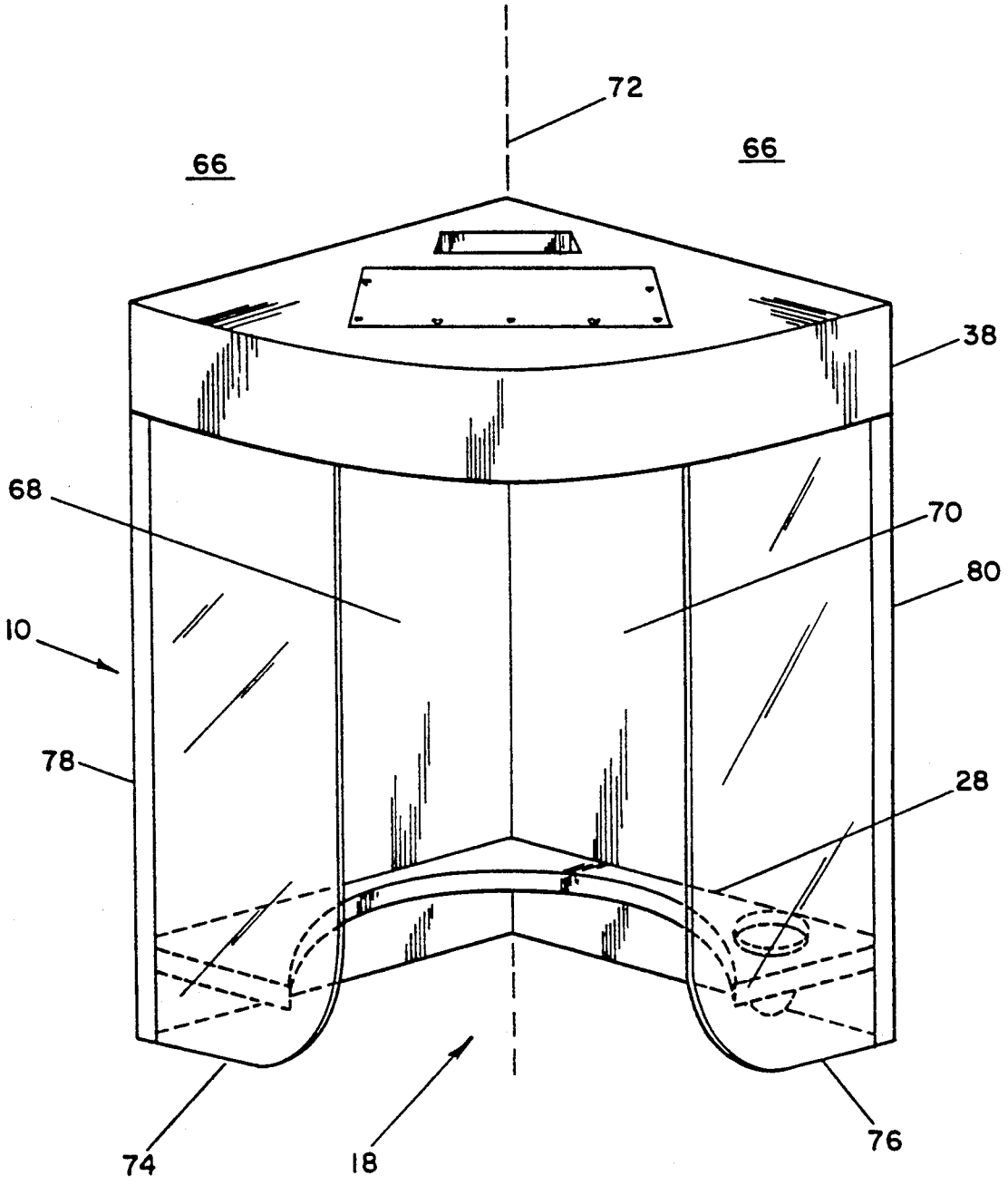
FIG. 5 is a perspective view of an alternative embodiment showing a configuration for mounting the smoker's booth in the corner of two walls.

FIG. 5 shows an alternative embodiment that includes a configuration for mounting the smoker's booth in the corner 72 of two facility walls 66. This configuration comprises four walls, two of which 68 and 70 are flat and joined at the corner 72 of the two facility walls to form the rear of the volume enclosure, and two of which 74 and 76 form right angles with the facility walls at the outside vertical edges 78 and 80 of the flat rear walls 68 and 70 and curve smoothly inwardly to form the smoker's front access aperture 18. The smoker's booth 10 is enclosed on the top by a ceiling and air handling, venting, and filtration compartment 38 (such as discussed above) that conforms to the shape created by the lateral walls 68, 70, 74, and 76 and the front access aperture 18. A convenience shelf 28 is attached to both flat rear walls 68 and 70 and both curved side walls 74 and 76. Other components of the corner configuration booth 10 are similar to those of the preferred embodiment discussed above.

Figure 6:
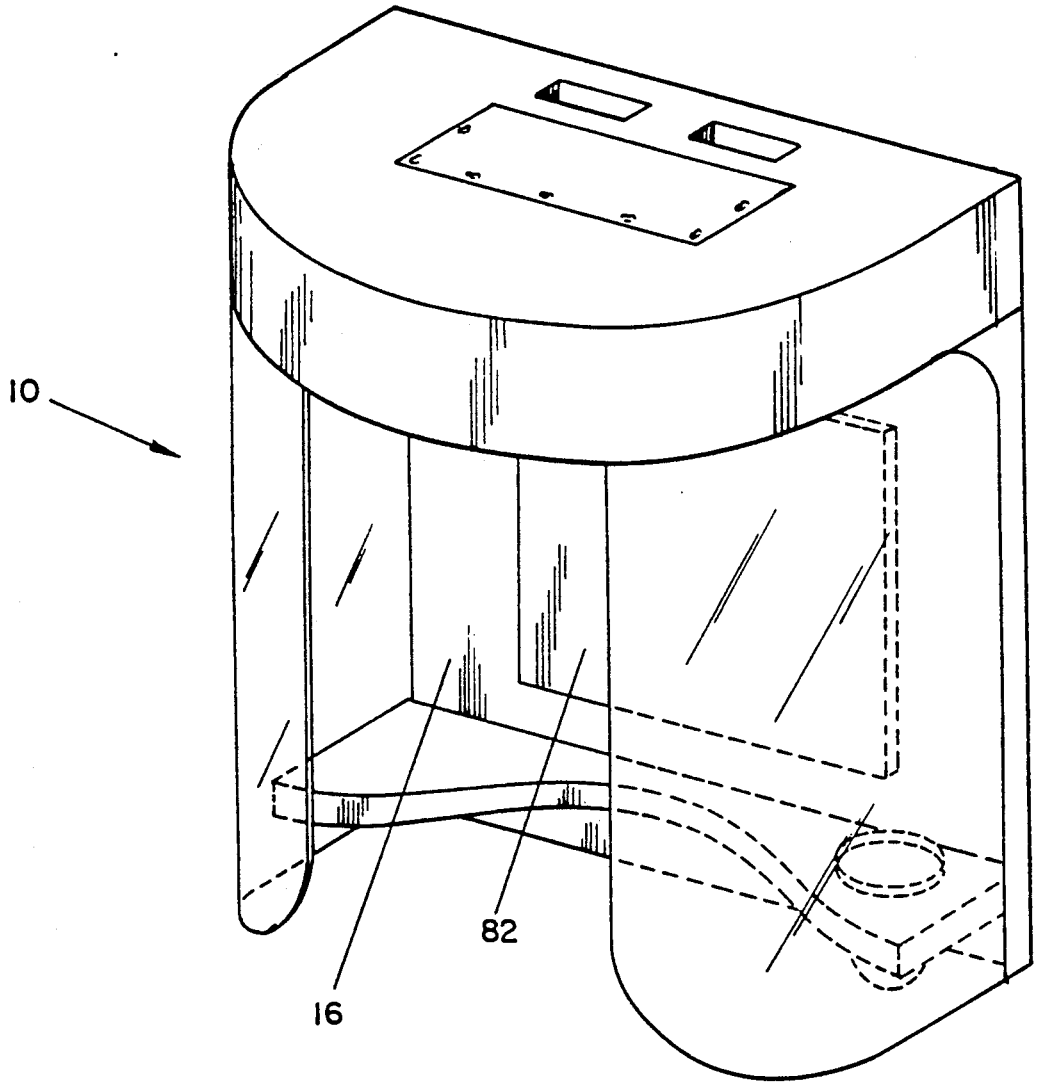
FIG. 6 is a perspective view of the FIG. 1 embodiment showing the rear wall for use as advertising space.

FIG. 6 illustrates an alternative embodiment wherein the rear wall 16 is adapted for use as advertising space or other indicia 82. Other possible, but not all inclusive, uses for the rear wall 16 or side walls are as spaces for appropriately sized vending machines (such as cigarette, butane lighter, breath freshners, chewing gum, etc.) telephones, magazine racks, televisions, and the like.

Figure 7:
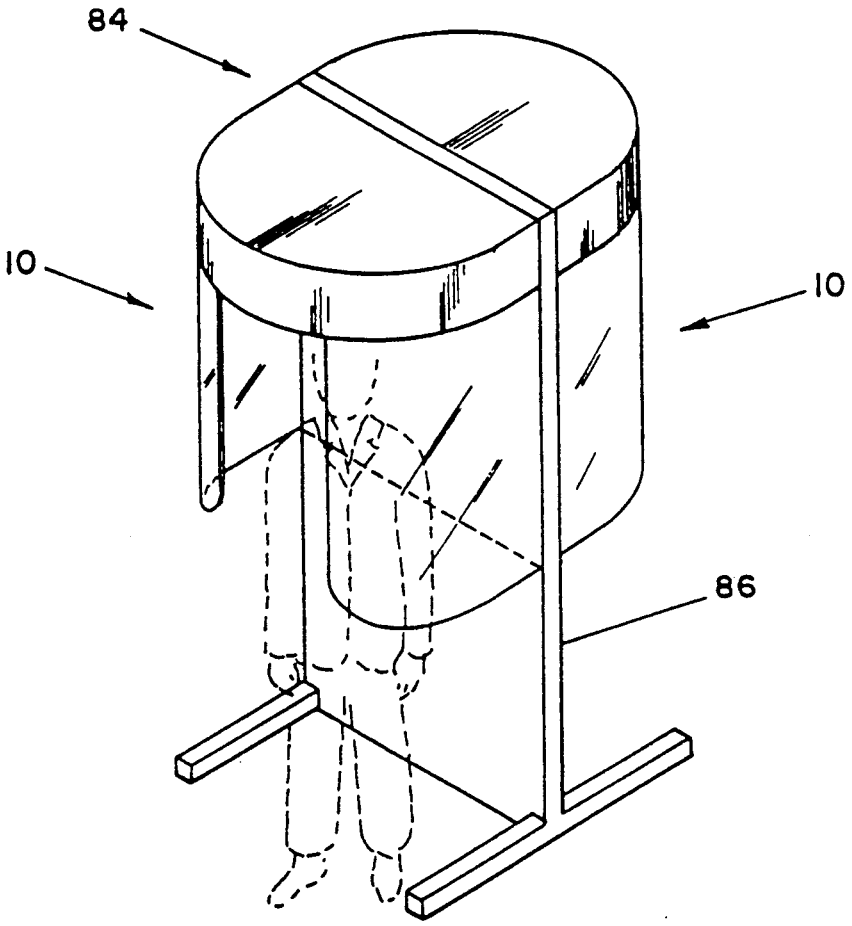
FIG. 7 is a perspective view of an alternative embodiment showing two smoker's booths back-to-back with a supporting structure that permits the invention to be floor mounted or free standing.

FIG. 7 shows yet another embodiment wherein two smoker's booths 10 are positioned back-to-back 84 with a supporting structure 86 that permits the present invention to be free standing or floor mounted. As can be appreciated by those skilled in the art, any number of booths can be joined in multiple configurations (e.g., three, four, and more) to allow the booths to be combined using shared or common rear walls, side walls, bases, and the like.

Figure 8:
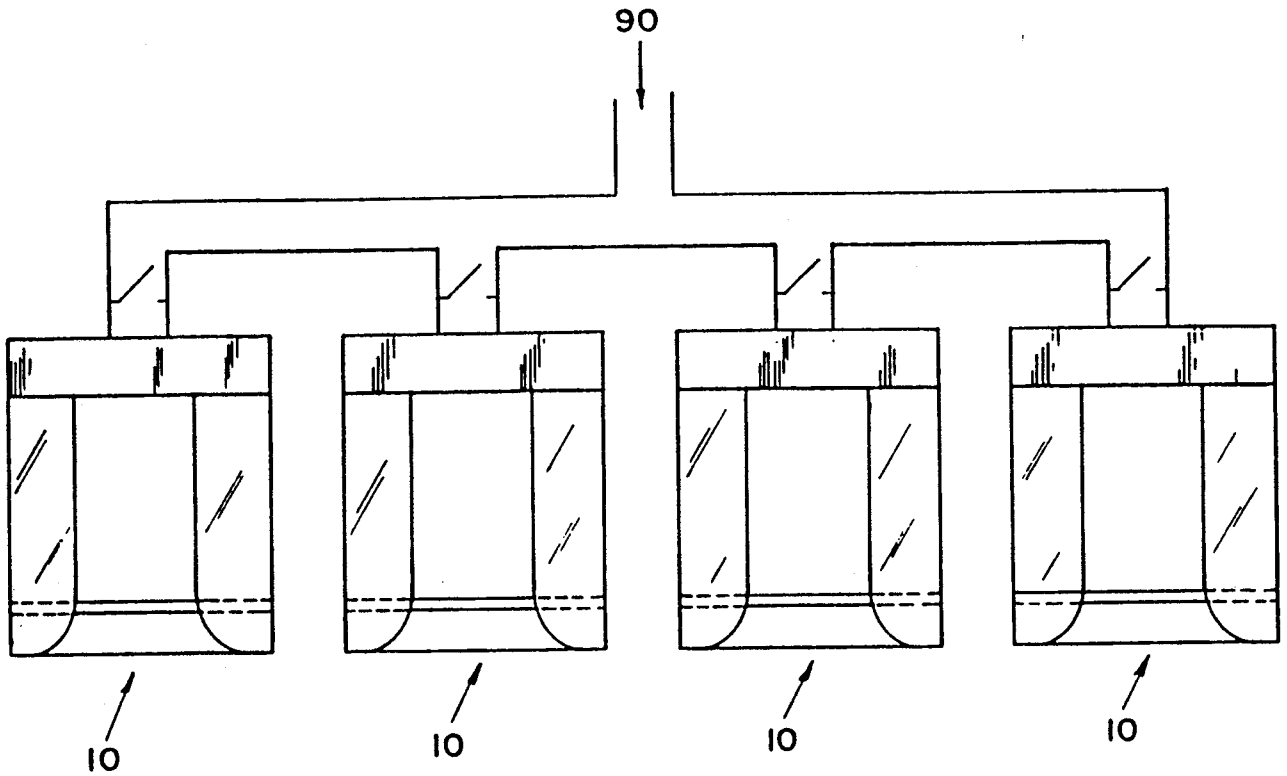
FIG. 8 is a front view of an alternative embodiment showing a plurality of smoker's booths joined by ducting that moves exhausted air to the facility heating, ventilating, and air conditioning system, or vents the air and smoke to the outside.

FIG. 8 illustrates another alternative embodiment having two or more booths 10 joined by common ducting 88 that moves the exhausted air, filtered or non-filtered, to a common heating, ventilating or air conditioning (HVAC) system 90 or vents the air and smoke to the outside. This same air handling technique could be applied to a single booth if convenient access to a facility HVAC system ducting is readily available or the unit is located where venting to the outside is practical.

Of course, other embodiments of the present invention may achieve the same results without departing from the basic principles of the invention. Thus, for instance, according to the particular application contemplated, the number and kind of filter elements, the positions of the air inlet opening, filters, fans, the countours and positioning of the side and rear walls and ceiling, the translucent nature and materials of the side walls, and the relative dimensions of the component elements of the smoker's booth may be varied to the specific application required. Further, closing means could be added to close the smoker's front access aperture, for example, if a specific application is required. Such closing means comprises, for example, swinging doors, sliding doors, curtains, and the like. The smoker's booth of this invention can also be used in other applications; for example, as an enclosure around an easy chair or couch in a lounge area, restaurant, or the like, by simply adapting the components of the present invention to the specific purpose and circumstances contemplated.

Although the invention has been described with reference to these preferred embodiments, other embodiments can achieve the same results. Variations and modifications of the present invention will be obvious to those skilled in the art and it is intended to cover in the appended claims all such modifications and equivalents.

We claim:

1. A smoker's booth for receiving and accommodating one or more smokers and for isolating smokers and tobacco smoke, said smoker's booth comprising:

walled enclosure means;

ceiling means;

smoker's access means disposed in said walled enclosure means for providing ingress and egress for the smokers; and means for venting tobacco smoke from said walled enclosure means and away from the vicinity proximate to said walled enclosure means, wherein said venting means further directs the tobacco smoke along a single flow path extending forwardly within said smoker's booth, and thereafter extending rearwardly within said smoker's booth, whereby the tobacco smoke is prevented from exiting said smoker's booth through said smoker's access means.

2. The invention of claim 1 wherein said walled enclosure means comprises side wall means.

3. The invention of claim 2 wherein said side walls means is curved in a wrap-around shape.

4. The invention of claim 3 wherein said smoker's access means is disposed between said wrap-around side walls.

5. The invention of claim 2 wherein said walled enclosure means further comprises back wall means.

6. The invention of claim 5 wherein said back wall means comprises a single back wall.

7. The invention of claim 5 wherein said back wall means comprises two back walls which meet in a corner configuration.

8. The invention of claim 5 wherein said back wall means is connected to said side wall means.

9. The invention of claim 5 wherein said back wall means is curved towards said smoker's access means at said ceiling means to assist in smoke movement towards said venting means.

10. The invention of claim 1 wherein said walled enclosure means comprises at least one material selected from the group consisting of transparent, translucent, and opaque materials.

11. The invention of claim 1 further comprising shelf means.

12. The invention of claim 11 wherein said shelf means comprises at least one ashtray.

13. The invention of claim 1 further comprising at least one ashtray.

14. The invention of claim 1 wherein said smoker's booth is wall mounted.

15. The invention of claim 14 wherein said walled enclosure means comprises partial walls disposed above a floor surface.

16. The invention of claim 1 wherein said smoker's booth is disposed on the floor.

17. The invention of claim 1 further comprising seat means.

18. The invention of claim 17 wherein said seat means comprises a foldable seat.

19. The invention of claim 18 wherein said foldable seat is mounted at the back of said smoker's booth.

20. The invention of claim 1 wherein said walled enclosure means comprises indicia.

21. The invention of claim 20 wherein said indicia is advertising.

22. The invention of claim 1 further comprising at least one member selected from the group consisting of vending machines, racks, television, and telephones.

23. The invention of claim 1 further comprising closing means for closing access to said smoker's booth.

24. A plurality of smoker's booths comprising:

walled enclosure means;

ceiling means;

smoker's access means disposed in said walled enclosure means for providing ingress and egress for the smokers;

common means for venting air and tobacco smoke from said plurality of smoker's booths, said venting means further directing said air and tobacco smoke along a single flow path extending forwardly within each smoker's booth, and thereafter extending rearwardly within each said smoker's booth, whereby the air and tobacco smoke is prevented from exiting each said smoker's booth through said smoker's access means.

25. The invention of claim 24 wherein said common means for venting air and tobacco smoke from said plurality of smoker's booths comprises common exhaust means.

26. The invention of claim 25 wherein said common means for venting air and tobacco smoke from said plurality of smoker's booths comprising a common heating, venting, and air conditioning system.

27. The invention of claim 24 wherein said plurality of smoker's booths comprises at least one shared wall enclosure means.

28. A plurality of smoker's booths for receiving and accommodating one or more smokers and for isolating smokers and tobacco smoke, said smoker's booths comprising:

at least one shared walled enclosure means;

ceiling means;

smoker's access means disposed in said walled enclosure means for providing ingress and egress for the smokers;

means for venting tobacco smoke from said walled enclosure means and away from the vicinity proximate to said walled enclosure means; and common exhaust means comprising a common heating, venting and air conditioning system.

* * * * *